US005807120A

United States Patent [19]

Matthews

[11] Patent Number: 5,807,120

[45] Date of Patent: Sep. 15, 1998

[54] PRINTED CIRCUIT BOARD POWER DISTRIBUTION CONNECTOR

[75] Inventor: Russell H. Matthews, Modesto, Calif.

[73] Assignee: Elcon Products International, Fremont, Calif.

[21] Appl. No.: 611,540

[22] Filed: Mar. 6, 1996

[51] Int. Cl.[6] ..... H01R 9/09

[52] U.S. Cl. ..... 439/80; 439/748

[58] Field of Search ..... 439/78, 79, 80, 439/746, 748, 947

[56] References Cited

U.S. PATENT DOCUMENTS

| | | | |
|---|---|---|---|
| 3,120,989 | 2/1964 | Solorow et al. | 439/256 |
| 3,383,643 | 5/1968 | Nava et al. | 439/205 |
| 3,471,822 | 10/1969 | Van Baelen | 439/18 |
| 3,560,911 | 2/1971 | Zimmerman, Jr. et al. | 439/258 |
| 3,587,029 | 6/1971 | Knowles | 439/14 |
| 3,697,933 | 10/1972 | Black et al. | 439/686 |
| 3,808,578 | 4/1974 | Hansen | 439/595 |
| 4,191,440 | 3/1980 | Schramm | 439/78 |
| 4,379,611 | 4/1983 | Foege et al. | 439/747 |
| 4,451,107 | 5/1984 | Dola et al. | 439/65 |
| 4,514,784 | 4/1985 | Williams et al. | 361/716 |
| 4,616,893 | 10/1986 | Feldman | 439/108 |
| 4,749,357 | 6/1988 | Foley | 439/80 |
| 4,824,380 | 4/1989 | Matthews | 439/78 |
| 4,854,899 | 8/1989 | Matthews | 439/724 |
| 4,946,392 | 8/1990 | Kobler et al. | 439/78 |
| 4,983,127 | 1/1991 | Kawai et al. | 439/79 |
| 5,055,055 | 10/1991 | Bakker | 439/78 |
| 5,088,942 | 2/1992 | Welsh et al. | 439/843 |
| 5,211,589 | 5/1993 | McCardell | 439/879 |
| 5,306,182 | 4/1994 | Fukushima et al. | 439/857 |
| 5,376,012 | 12/1994 | Clark | 439/80 |
| 5,547,400 | 8/1996 | Wright | 439/731 |

*Primary Examiner*—P. Austin Bradley
*Assistant Examiner*—T. C. Patel
*Attorney, Agent, or Firm*—Burns, Doane, Swecker & Mathis, LLP

[57] ABSTRACT

An electrical connector having a reduced DIP footprint for a power distribution system for a printed circuit board is provided. The electrical connector achieves a smaller footprint (with a correspondingly small area taken up on the printed circuit board) than is currently available for power distribution system connectors. The electrical connector has an electrically conductive body having an arcuate section with at least one contact terminal being integrally formed therewith and extending from a lower portion of a first side and a second side of the conductive body for attaching to the printed circuit board. The conductive body is retained in an electrically insulating housing by a latching element integrally formed therewith and extending outwardly therefrom on each side of the conductive body.

11 Claims, 6 Drawing Sheets

PRINTED CIRCUIT BOARD POWER DISTRIBUTION CONNECTOR

BACKGROUND OF THE INVENTION

1. Field of the Invention

In general this invention relates to power distribution connectors for permitting electrical communication between printed circuit boards. More particularly, this invention relates to power distribution connectors for transferring high current between interconnected printed circuit boards, such as a mother board and daughter board arrangement. The present invention provides a power distribution connector that has a reduced footprint and a correspondingly small area taken up on the printed circuit board to which it is mounted.

2. Prior Art

The continuing trend toward high density circuitry has initiated the evolution of printed circuit board connectors which permit electrical communication between a system of bus boards or which transfer power to a mother board from a daughter board. The standard dual-in-line (DIP) footprint for either solder or press fit terminations is 0.3 inch by 0.1 inch. In response to the need for compact circuit elements, connectors with multi-contact capabilities have been fabricated. These multi-contact connectors are generally bussed together to achieve high current carrying capabilities. Although such connectors facilitate board/board power distribution, all bussed connections must be reliable and exact and, thus are time consuming to assemble and subject to assembly defects. Moreover, maintenance of the multi-contact connectors have proven laborious and costly.

As an alternative to multi-contact connectors, hard wiring methods have been employed which involve soldering, or otherwise mechanically attaching, discrete wires to current carrying devices mounted on printed circuit boards. However, again such systems are labor intensive to assemble and have a significant drawback of poor field serviceability.

In the recent past, attempts have been made to alleviate the problems associated with bussed contact and discrete wiring. One such attempt included a system of printed circuit board connectors, as disclosed in U.S. Pat. No. 4,749,357 to Foley, which permitted various board/board interplanar relationships without requiring the labor intensive assembly process found in prior art power distribution systems, This system of printed circuit board connectors utilized interchangeable parts so that varied printed circuit board arrangements could be constructed. These circuit board connectors generally included a bus element and an electrical mating contact supported by an integrally attached insulating block, and male and female connectors were recognized in this design.

In an effort to reduce fabrication costs, an improvement was made in the above-described modular connector system. The improved connectors, which have a smaller number of parts, were designed to increase flexibility in the number of possible board/board configurations, as disclosed in U.S. Pat. No. 4,824,380 to Matthews. These more recent modular connectors generally included an insulative housing and a conductive element inserted within the housing. During fabrication, the conductive member was stamped from a sheet of flat metal stock and then bent into shape on a suitable mandrel. The housing was then press fit to the conductive member. The housing included an integrally attached, insulative arm which permitted a common conductor element to extend between adjacent connectors without possible inadvertent contact with other circuit elements.

Though such modular connectors included male and female-type connector elements and permitted chains of circuit boards to be interconnected, precise placement and alignment of the connectors were necessary for proper electrical communication, Further, a more time-efficient method of assembling the housing to the conductive member was desired. In response to the need for a design to further ease connector assembly and to increase connector utility in transferring power from board to board improvement was made in the above-described modular connector systems as disclosed in U.S. Pat. No. 5,055,055 to Bakker.

In conventional printed board circuitry, electrical communication between a series of boards, such as between a mother board and a daughter board, has also been realized by matingly engaging an electrically conductive pin mounted on one board with a compatible socket mounted on a second board. Current practice involves securely fastening the conductive pin in a rigid perpendicular posture with respect to the circuit board, resulting in a relatively inflexible engagement between the pin and the socket. The continuing trend toward high density circuitry on printed circuit boards has created the need for printed circuit board connectors which have smaller DIP footprints and take up less area on the printed circuit board.

SUMMARY OF THE INVENTION

A preferred embodiment of the invention which is intended to accomplish at least some of the foregoing objects generally includes an electrical connector having an electrically conductive body adapted for receiving an electrically conductive contact pin, at least one contact terminal electrically connected to the conductive body for attaching the connector to a printed circuit board or the like, an electrically insulating housing mounted on and substantially surrounding the conductive body and an electrically insulating member mounted in the housing to help maintain the at least one contact terminal in the proper orientation. The conductive body includes a resiliently displaceable portion which carries latching shoulders to securely engage the insulating housing. The conductive body, in combination with the housing, may serve as a female-type connector to receive a mating contact pin or a male-type connector with a contact pin securely retained therein. The conductive body of the present invention has a reduced DIP footprint from the standard 0.3 inches by 0.1 inches footprint to a DIP footprint of 0.2 inches by 0.1 inches or 0.1 inches by 0.1 inches. These footprints are illustrative, and not absolute, sizes for the present invention.

In one aspect of the present invention, there is provided an electrical connector for a power distribution system, comprising an electrically conductive body having an arcuate section with at least one contact terminal being integrally formed therewith and extending from a lower portion therefrom for attaching to a printed circuit board, the arcuate section having at least one latching element integrally formed therewith and extending outwardly therefrom and an electrically insulating housing substantially surrounding the conductive body, the housing having a first opening in a bottom thereof into a cavity having a recess along at least one side thereof for receiving the at least one latching element and a second opening in another surface thereof for receiving a conductive pin.

In another aspect of the invention, there is provided an electrical connector having a reduced footprint for a power distribution system for a printed circuit board, comprising an electrically conductive body having an arcuate section with at least one contact terminal being integrally formed therewith and extending from a lower portion of a first side and a second side of the conductive body for attaching to the printed circuit board, the arcuate section having a first latching element integrally formed therewith and extending outwardly therefrom on the first side of the conductive body and a second latching element integrally formed therewith and extending outwardly therefrom on the second side of the conductive body and an electrically insulating housing substantially surrounding the conductive body, the housing having a first opening in a bottom thereof into a cavity having a first recess along a first side thereof for receiving the first latching element and a second recess along a second side thereof for receiving the second latching element, the housing having a second opening in another surface thereof for receiving a conductive pin.

In yet another aspect of the invention, there is provided an integrally formed, one piece electrically conductive body for an electrical connector, comprising an arcuate section with a plurality of contact terminals being integrally formed therewith and extending from a lower portion therefrom for attaching to a printed circuit board, the arcuate section having at least one latching element integrally formed therewith and extending outwardly therefrom.

In another aspect of the invention, there is provided an integrally formed, one piece electrically conductive body for an electrical connector, comprising an arcuate section with a plurality of contact terminals being integrally formed therewith and extending from a lower portion of a first side and a second side of the conductive body for attaching to a printed circuit board, the arcuate section having a first latching element integrally formed therewith and extending outwardly therefrom on the first side of the conductive body and a second latching element integrally formed therewith and extending outwardly therefrom on the second side of the conductive body.

BRIEF DESCRIPTION OF THE DRAWING

Other objects and advantages of the present invention will become apparent from the following detailed description of the preferred embodiments thereof taken in conjunction with the accompanying drawings wherein.

DETAILED DESCRIPTION OF THE PREFERRED EMBODIMENTS

Figure 1:
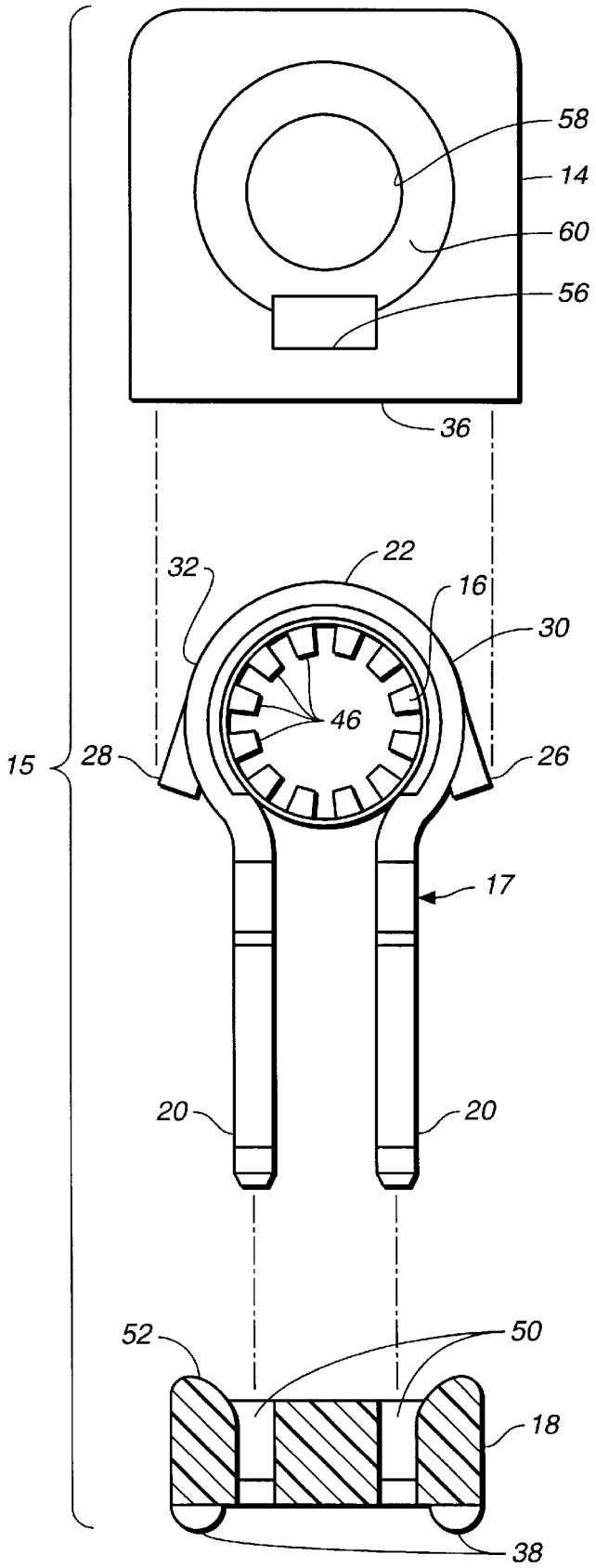
FIG. 1 is an exploded end elevational view, with the alignment member in cross section, of an electrical connector in accordance with one embodiment of the present invention.
Figure 2:
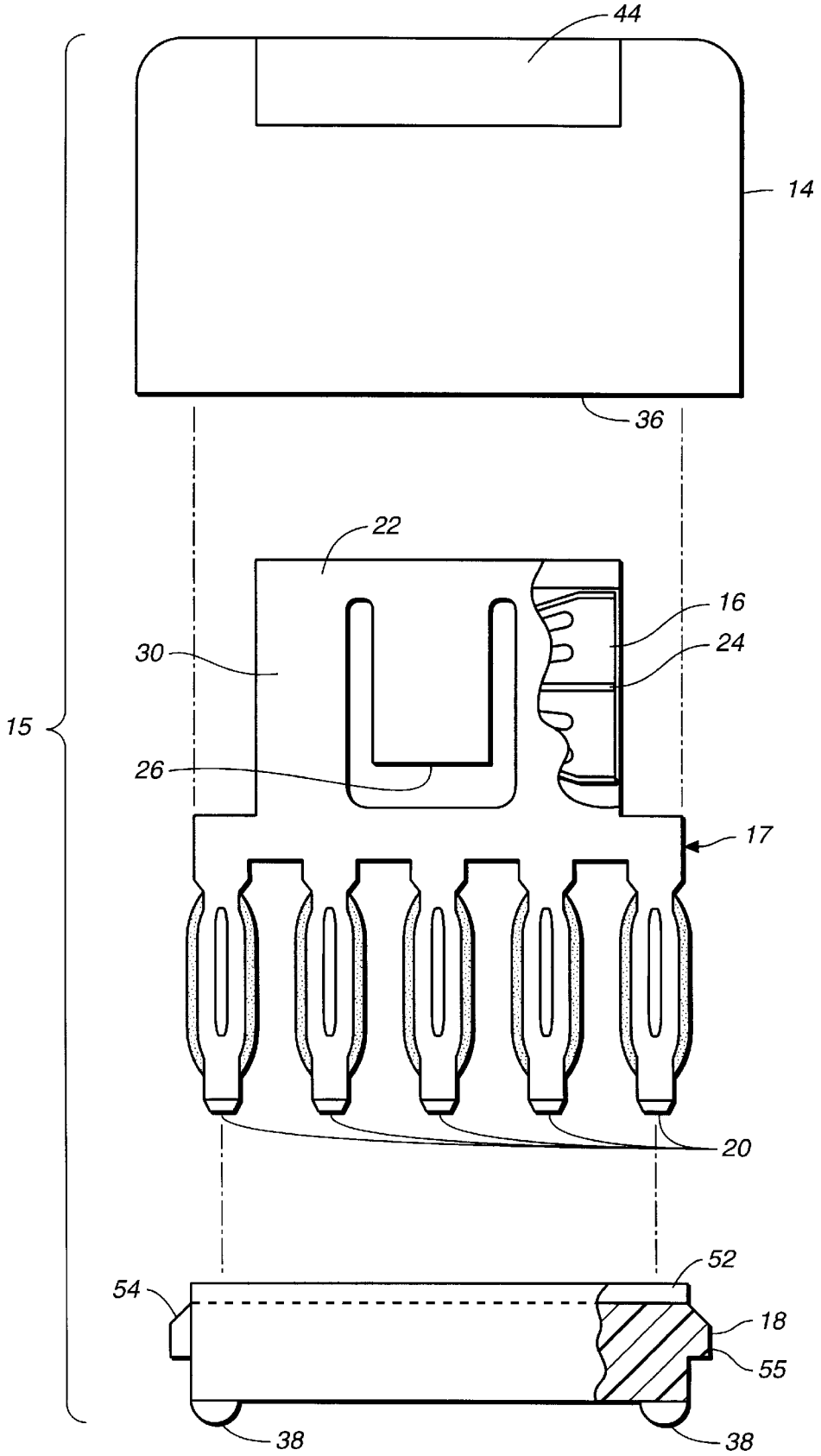
FIG. 2 is an exploded side elevational view of the electrical connector of FIG. 1.
Figure 3:
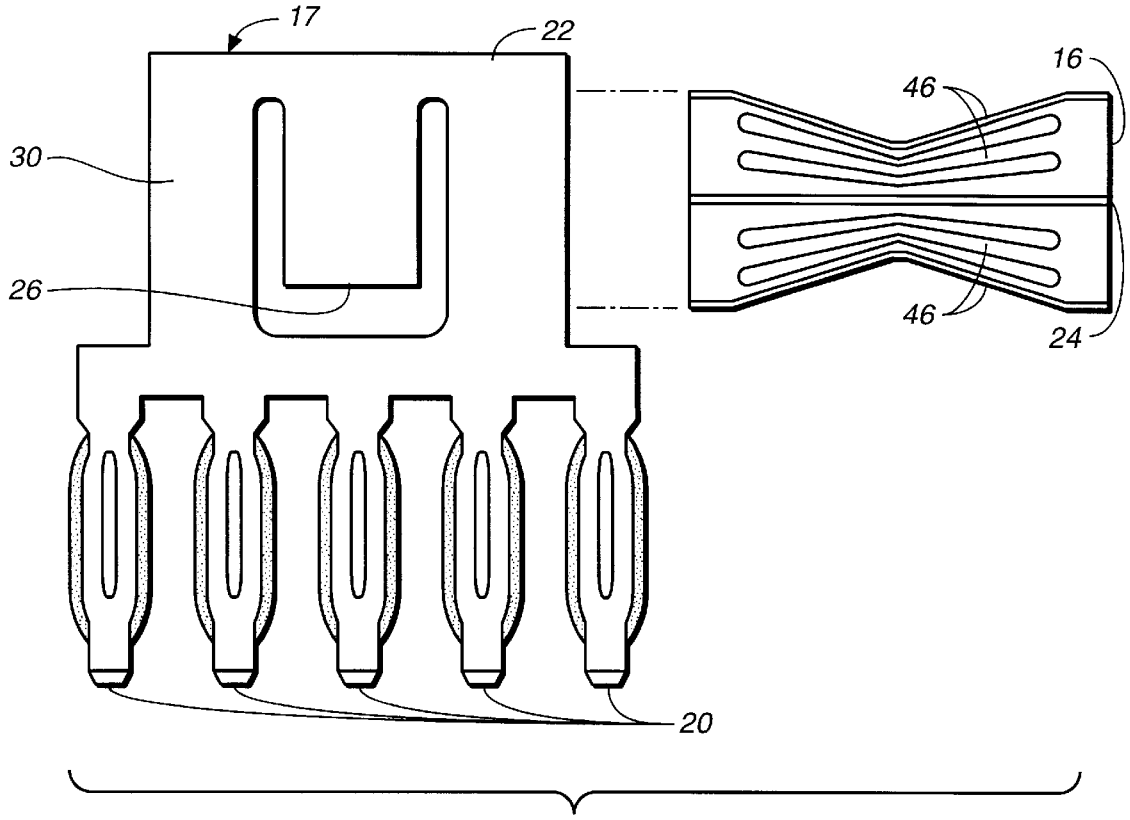
FIG. 3 is an exploded side elevational view of an electrical contact prior to assembly in an electrically conductive body.
Figure 4:
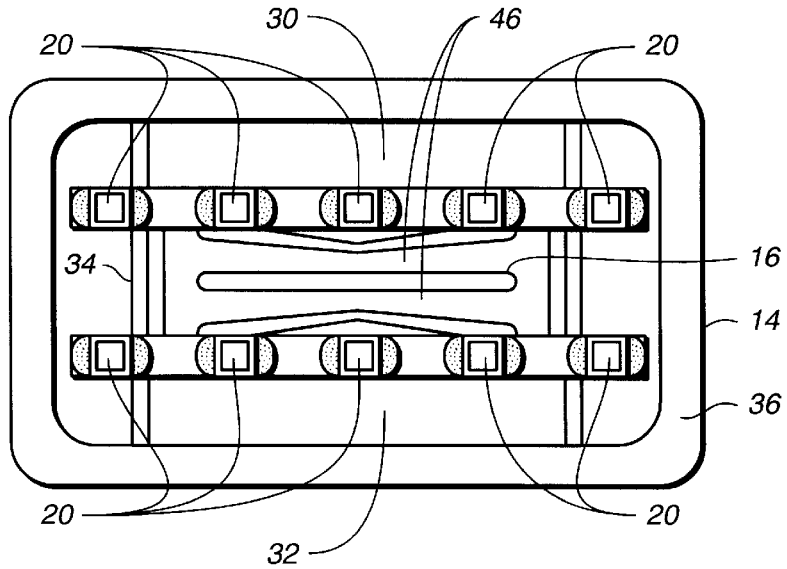
FIG. 4 is a bottom plan view of the assembly of FIG. 3 inserted into the electrically insulating housing.

Referring now to the drawings, wherein like numerals indicate like parts, and initially to FIGS. 1, 2, and 3 there will be seen a female-type electrical connector, generally designated 15, for use in a power distribution system for connecting printed circuit boards together in accordance with one embodiment of the invention. Electrical connector 15 generally includes an electrically conductive body 17, an electrically insulating housing 14 which substantially surrounds conductive body 17 when body 17 is inserted in the housing 14, an electrical contact band 16, and an electrically insulating alignment member 18. Housing 14 has an opening 58,59 on each end to permit entry of a mating contact pin (not shown) into either end of electrical connector 15. Openings 58,59 preferably have a generally beveled entrance configuration 60,61 to guide a mating contact pin into connector 15. The beveled surfaces 60,61 are typically inclined with respect to the longitudinal axis of the housing 14 by an angle of 45 degrees or less. The angle of the beveled surfaces is selected so that the surfaces function as cam surfaces to guide a contact pin (not shown) into the housing without friction locking. In normal operation, if the contact pin is slightly misaligned from the opening 58 or 59 in housing 14, the beveled surface causes relative positional adjustment between the contact pin and the opening into the housing. The housing 14 is preferably fabricated of a polyester, flame-retardant plastic but other materials such as any rigid thermoset or thermoplastic can be used. It is important that the housing material be an electrical insulator in order to reduce the possibility of electrical shock hazard.

Figure 5:
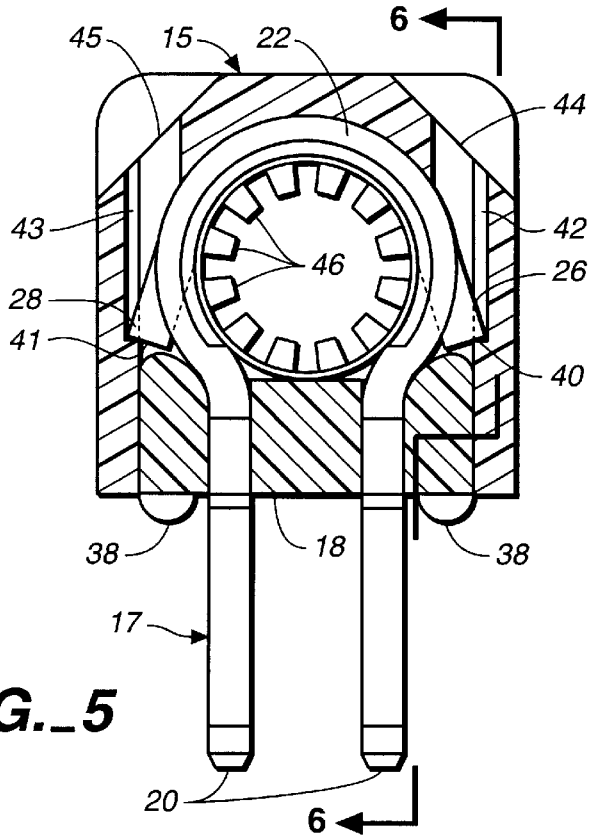
FIG. 5 is a partial cross-sectional view of the electrical connector of one embodiment of the present invention in an assembled state.
Figure 6:
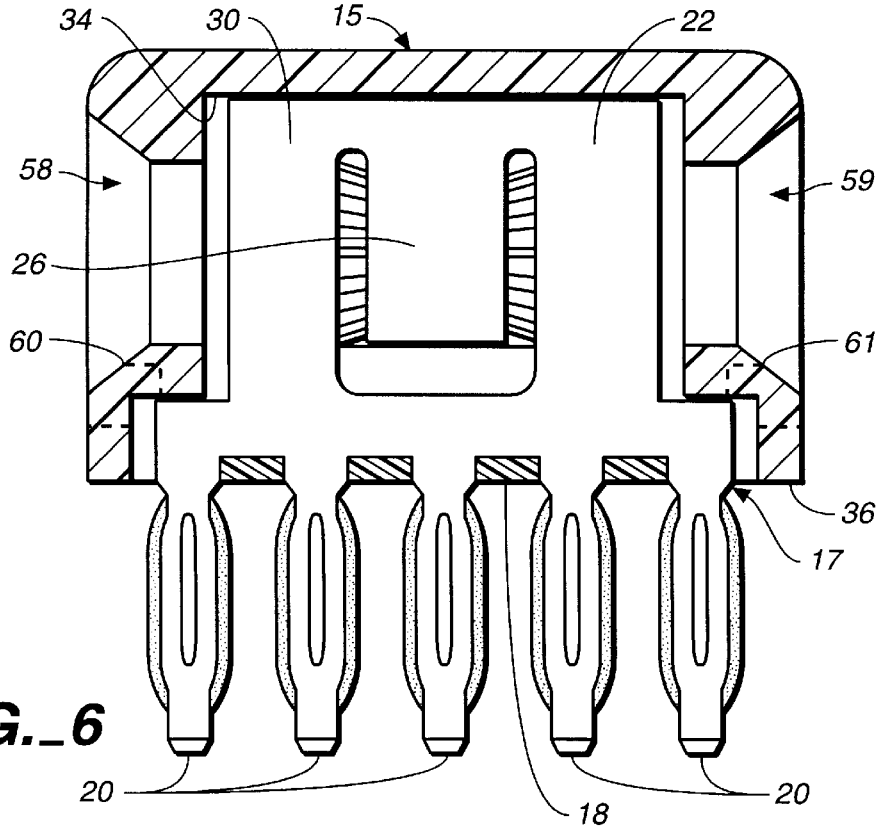
FIG. 6 is a partial cross-sectional view of the electrical connector of FIG. 5 taken along line 6—6.

The housing 14 has an internal cavity 34 (FIG. 6) sized and configured to receive, retain and substantially surround the electrically conductive body 17. The internal cavity is open to the bottom 36 of the housing 14. The cavity 34 is sized to tightly receive the arcuate section 22 of the conductive body 17. Each side of the cavity 34 may include a recess or abutment surface 40,41 and channel 42,43 for receiving and retaining a first latching element 26 and a second latching element 28, respectively, extending outwardly from the conductive body 17. In cross-section, each of the channels 42,43 are generally rectangular. Recesses 40,41 extend away from the cavity 34 into the housing 14. Each channel 42,43 can, but does not have to, extend into a corresponding inclined surface 44,45 (FIG. 5). By extending the channels 42,43 to the inclined surfaces at the top of the housing, access to those channels 42,43 is provided for a latch release tool (not shown). The inclined surfaces 44,45 need not be inclined but material is saved by inclining them.

Conductive body 17 has a generally arcuate section 22 which extends along the length of the conductive body 17 and is configured to tightly receive electrical contact 16. A plurality of electrically conductive contact terminals 20 are integrally formed on conductive body 17 for insertion into mating holes on a printed circuit board (not shown). A standard 10-pin dual-in-line package (DIP) configuration is shown; however other configurations can be used such as an 8-pin configuration as found in CMOS technology. Likewise, press-fit terminations are shown but solder terminations can be used as well. The contact terminals 20 transition and extend from a lower portion of a first side 30 and a second side 32 of the conductive body 17 in a novel configuration that allows for a smaller than standard DIP footprint. The standard DIP footprint is 0.3 inches from the center of a contact terminal on one side of the package to the center of a contact terminal on the other side of the package and 0.1 inches between the centers of contact terminals on the same side of the package. With the novel configuration of the present invention, a DIP footprint of 0.1 inches by 0.1 inches can be achieved. Likewise, the amount of space (i.e., "real estate") that is taken up on the printed circuit board by the connector 15 is reduced. In addition, DIP footprints of less than 0.1 inches by 0.1 inches can be provided by curving the conductive body 17 farther around the contact 16 before transitioning into the plurality of contact terminals 20 on each side of the conductive body. These reduced sizes are achieved due to the novel configuration of the conductive body 17 which is stamped out of thin metal sheet material and formed into the arcuate shape. The thin sheet material such as high conductivity, oxygen-free copper, or any other metal such as beryllium copper, aluminum, steel, etc. allows for a smaller dimensioned conductive body than has heretofore been provided. Advantageously, with the contact terminals 20 integrally formed with arcuate section 22, there is no subassembly required to produce electrical connectors with press-fit contact terminals. Likewise, there is no soldering or bonding operation required to connect the contact terminals to the conductive body.

During assembly of the female-type electrical connector 15, electrical contact 16 is friction or interference fit in arcuate section 22. This is generally accomplished by squeezing the contact so that gap 24 is closed, sliding the contact into arcuate section 22 as shown in FIG. 3 and then releasing the contact so that it presses tightly against the inside surface of the arcuate section 22. The mounting of electrical contact 16 into conductive body 17 provides excellent electrical communication between a male mating pin contact (not shown) received therein and the conductive body. The electrical contact 16 has a multiplicity of curved, resilient contact members 46 which are deformed inwardly so that the contact members 46 present a contact portion for a mating pin contact (not shown) to be received therein or for a pin contact 48 (FIG. 7) to be described in more detail below.

The next assembly step involves latching conductive body 17 with electrical contact 16 therein into housing 14 as shown in FIGS. 1 and 2. The arcuate section 22 of conductive body 17 has a first latching element 26 integrally formed therewith and extending outwardly therefrom on the first side 30 of the conductive body and a second latching element 28 integrally formed therewith and extending outwardly therefrom on the second side 32 of the conductive body 17. With the configuration for the conductive body 17 shown in FIGS. 1–7, only one side of the conductive body 17 need have a latching element for securing the conductive body 17 in the housing 14. However, when a latching element is used on each side as shown, each latching element 26,28 is preferably centrally positioned along each side 30,32, respectively, of the conductive body 17. Moreover, each latching element is shaped and positioned such that the latching element is received in the corresponding channel 42,43 of the housing 14. For simplicity, the latching elements 26,28 are identical, however, it is within the scope of the invention that those projections may have different shapes and/or proportions, if desired. With the foregoing arrangement, when conductive body 17 with contact 16 inserted therein is slid into the housing 14, the latching element 26,28 on each side 30,32 respectively of the conductive body are resiliently deflected inward as the conductive body 17 is inserted into the internal cavity 34. When the conductive body is substantially inserted into the internal cavity 34, the latching elements 26,28 spring outwardly into the corresponding channels 42,43, and securely lock the conductive body 17 in place in the housing 14 by engaging the recesses 40,41, respectively.

A final assembly step involves pressing alignment member 18 into the opening in the bottom 36 of housing 14. Alignment member 18 has openings 50 with beveled surface 52 for receiving the contact terminals 20 of the conductive body 17. Alignment member 18 helps in maintaining the contact terminals square and on center in the proper orientation, particularly for the press fit terminations which are inserted and removed from a printed circuit board. Alignment member 18 has protrusions 54,55 which are received in corresponding cavities (not shown) in the front and rear surfaces of the internal cavity 34 of housing 14. An opening 56 can be provided in the front and rear of the housing 14 to provide access to the protrusions 54,55 for a latch release tool (not shown). Alignment member 18 is not necessary for retaining conductive body 17 in housing 14. Alignment member 18 has a plurality of stand-off protrusions 38 on the bottom surface thereof to maintain the connector in spaced relation with respect to the printed circuit board 62 (FIG. 7) to which it is mounted. This is advantageous in that the electrical connector and printed circuit board assembly must be washed to remove residual masking material and any materials which were deposited on the board during assembly, and the spacing provided by the protrusions 38 affords ventilation between the connector 15 and the printed circuit board 62, allowing the cleaning solution to dry. The alignment member 18 is preferably fabricated of a polyester, flame-retardant plastic but other materials such as any rigid thermoset or thermoplastic can be used.

Figure 7:
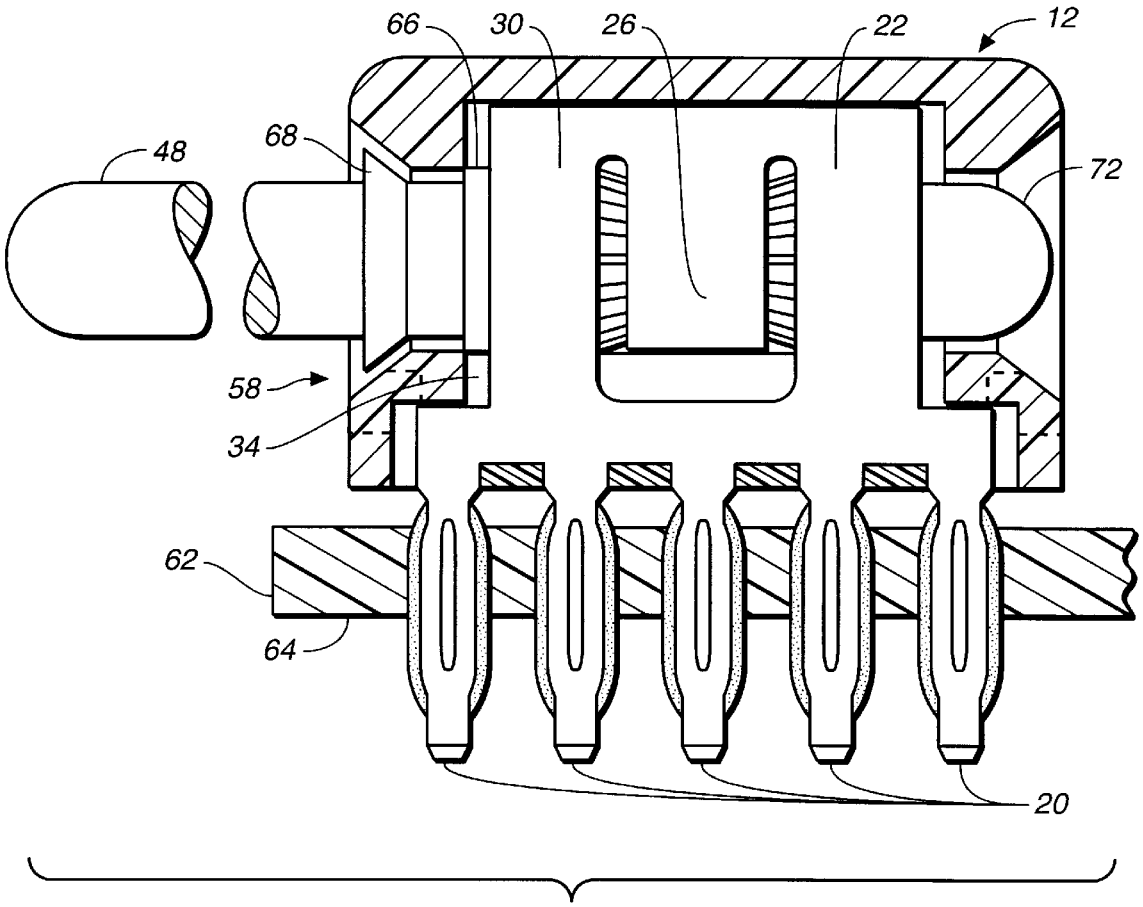
FIG. 7 is a partial cross-sectional view of a male-type electrical connector in accordance with one embodiment of the present invention.

Another embodiment of the present invention is shown in FIG. 7. In this embodiment, the female-type electrical connector 15 as described above is converted from a female-type connector 15 to a male-type connector 12. An electrical contact 16 is disposed in arcuate section 22 of conductive body 17 to act as a receiving portion. A contact pin 48 is provided to accomplish the gender conversion. The rear portion 72 of contact pin 48 is inserted through opening 58 into arcuate section 22 so that electrical contact 16 resiliently engages the outer surface of contact pin 48. Contact pin 48 is provided with locking protrusion 66 which deflects the housing 14 slightly upon insertion and then is retained in cavity 34 as the housing 14 returns to its normal configuration. Beveled surface 68 can be provided around contact pin 48 spaced from the locking protrusion 66 to prevent the contact pin 48 from being inserted too far into the housing 14. Thus, it is seen that by securing or eliminating a contact pin, the connector may be fabricated as a male or female connector. This versatile construction reduces the number of parts necessary to complete an electrical connector assembly and thus decreases manufacturing cost.

Electrical contact 16 is deflectable and resilient to permit lateral floating displacement of contact pin 48 relative to the longitudinal axis of the contact pin to accommodate misalignments in the orientation between two printed circuit boards (not shown) which are being connected. Likewise, contact pin 48 can be displaced to accommodate relative angular misalignment between the two printed circuit boards such as may be caused by thermal and/or mechanical stress which may change the relative positioning of the two electrically connected printed circuit boards from an ideal perpendicular or parallel relationship.

Male-type electrical connector 12 is mounted to a printed circuit board 62 (FIG. 7) with compliant press fit contact terminals 20 as is generally known by one of ordinary skill for releasable attachment of the connector 12 to the printed circuit board. In general, circuitry is etched on one side 64 of a printed circuit board 62, and any number of electrical power connectors (male or female) are mounted on the side of the board opposite the etched circuitry. Alternatively, contact terminals 20 can be soldered to the board to permanently affix the connector onto the printed circuit board.

Figure 8:
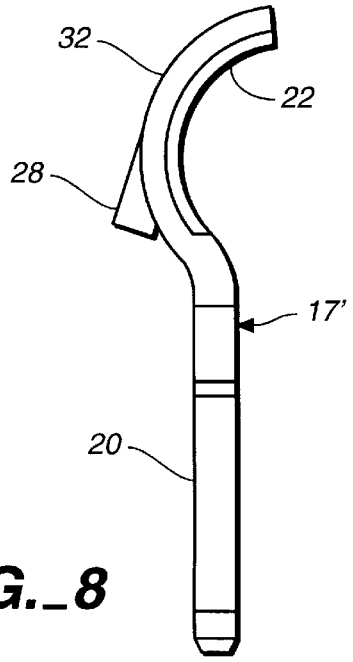
FIG. 8 is an end elevational view of an electrically conductive body in accordance with another embodiment of the present invention.
Figure 9:
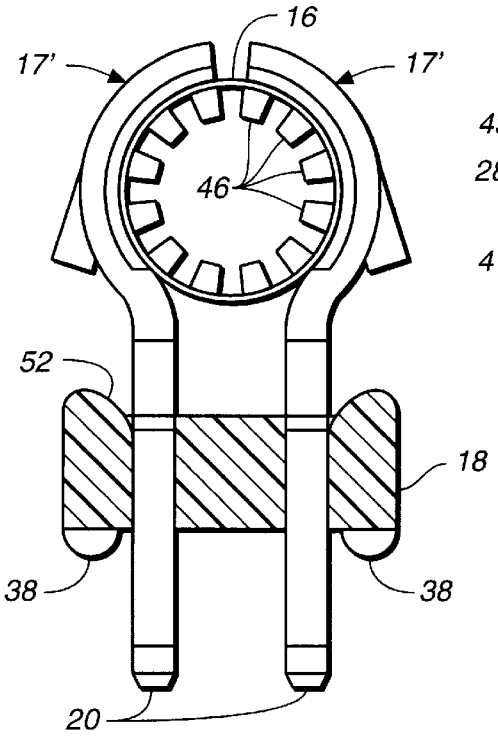
FIG. 9 is a partial cross-sectional view of the alignment member, electrically conductive body and electrical contact in an assembled state in accordance with another embodiment of the present invention.
Figure 10:
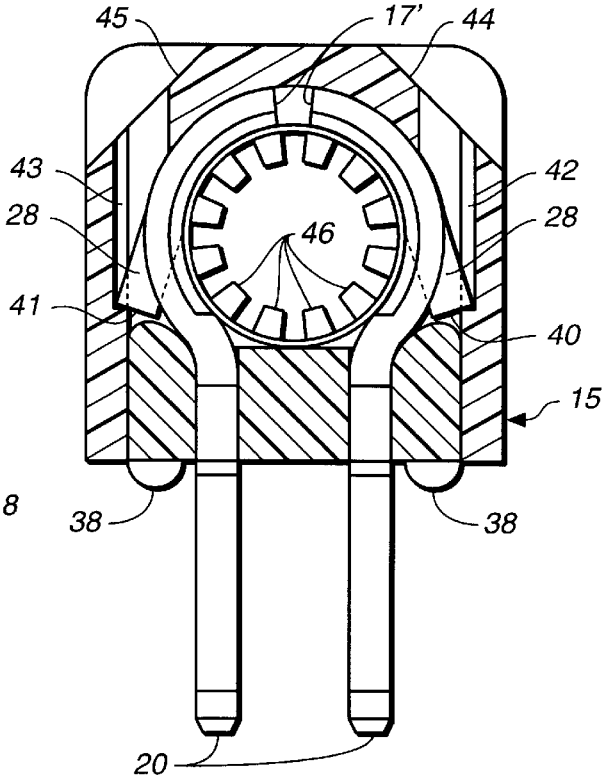
FIG. 10 is a partial cross-sectional view of the electrical connector in an assembled state in accordance with another embodiment of the present invention.

In another embodiment of the present invention, shown in FIGS. 8–10, the cost of tooling is reduced by tooling essentially just half of the conductive body described above resulting in conductive body 17'. Conductive body 17' has arcuate section 22 for receiving contact 16, a latching element 28 and plurality of contact terminals 20. Since conductive body 17' is symmetrical, a second conductive body 17' can be rotated 180 degrees from the first conductive body 17' and matched with the first conductive body 17' to receive contact 16 (FIG. 9). Alignment member 18 is useful in this embodiment for being placed over the plurality of contact terminals 20 on each conductive body 17' to help retain contact 16 between the two conductive bodies prior to the two conductive bodies being inserted into the housing 14. That assembly is then inserted into the housing 14 as described above with latching elements 28 being retained in channels 42,43. Although assembly is simplified by sliding the two conductive bodies into the alignment member 18 prior to insertion in the housing 14, it is also contemplated that the two conductive bodies can be inserted into the housing 14 and alignment member 18 inserted subsequent thereto as described above with respect to FIGS. 1 and 2.

Figure 11:
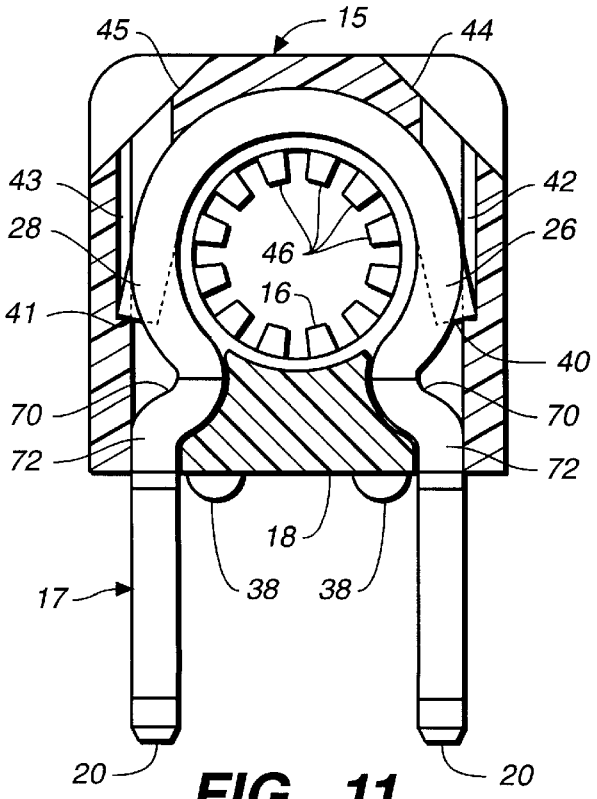
FIG. 11 is a partial cross-sectional view of another embodiment of the electrical connector in accordance with the present invention.

FIG. 11 is another embodiment of the present invention for providing an electrical connector 15 having a 0.2 inches by 0.1 inches DIP footprint without increasing the "real estate" of the connector described above. Electrical connector 15 is essentially the same as described above with respect to FIGS. 1–7 (or can be manufactured as described with respect to FIGS. 8–10) except that in the portion in which the arcuate section 22 of conductive body 17 transitions into the plurality of contact terminals additional bends 70 and 72 are provided to widen the distance between the plurality of contact terminals on one side of the conductive body 17 and the plurality of contact terminals on the other side of the conductive body. Accordingly, alignment member 18 is modified to accommodate the bends and to maintain reduced "real estate" by locating the protrusions 38 in the space between the plurality of contact terminals on one side and the plurality of contact terminals on the other side of the connector. It is contemplated that other size DIP footprints can be provided by providing different radius of curvatures of the bends 70 and 72.

As will be appreciated by one of ordinary skill in the art, a contact pin (not shown) is typically mounted in a printed circuit board on a first printed circuit board to mate with the female-type electrical connector 15 which is mounted on a second printed circuit board. A printed circuit board mounted contact pin (not shown) in accordance with the present invention includes a generally cylindrical conductive body which is configured to extend through the printed circuit board. The portion of the conductive body that extends through the printed circuit board has a knurled cylindrical surface to prevent the contact pin from rotating within the printed circuit board. The conductive body includes an annular rim which serves as a stop when the knurled portion of the conductive body is inserted through the printed circuit board. An electrically conductive fastener is threadingly mounted from the other side of the printed circuit board into a threaded bore within the knurled portion of the conductive body to bind the annular rim to the printed circuit board so that the contact pin is not pulled away from the printed circuit board to which it is mounted when the second printed circuit board is pulled away.

It will now be apparent that an electrical connector has been described which overcomes the problems and deficiencies associated with prior devices. Moreover, it will be apparent to those skilled in the art that various modifications, variations, substitutions, and equivalents exist for various elements of the invention but which do not materially depart from the spirit and scope of the invention as defined by the appended claims.

The invention claimed is:

1. An electrical connector for a power distribution system, comprising:

an electrically conductive body formed of sheet metal having an arcuate section with at least one contact terminal being integrally formed therewith and extending from a lower portion therefrom for attaching to a printed circuit board, the arcuate section having at least one latching element integrally formed therewith and extending outwardly therefrom;

an electrical contact having a multiplicity of curved, resilient contact members mounted in the arcuate section of the conductive body; and an electrically insulating housing substantially surrounding the conductive body, the housing having a first opening in a bottom thereof into a cavity having a recess along at least one side thereof for receiving the at least one latching element and a second opening in another surface thereof for receiving a mating conductive pin.

2. The electrical connector of claim 1, further comprising:

a contact pin mounted in the arcuate section of the conductive body, the contact pin retained within and extending through the second opening in the housing.

3. The electrical connector of claim 1, further comprising:

a second electrically conductive body having an arcuate section with at least one contact terminal being integrally formed therewith and extending from a lower portion therefrom for attaching to a printed circuit board, the arcuate section having at least one latching element integrally formed therewith and extending outwardly therefrom; and the electrically insulating housing having a second recess along a side of the cavity opposite of the recess for receiving the at least one latching element of the second electrically conductive body.

4. The electrical connector of claim 1, further comprising:

an electrically insulating member mounted in the first opening of the housing.

5. The electrical connector of claim 4 wherein the at least one contact terminal extends through an opening through the insulating member.

6. An electrical connector having a reduced footprint for a power distribution system for a printed circuit board, comprising:

an electrically conductive body formed of sheet metal having an arcuate section with at least one contact terminal being integrally formed therewith and extending from a lower portion of a first side and a second side of the conductive body for attaching to the printed circuit board, the arcuate section having a first latching element integrally formed therewith and extending outwardly therefrom on the first side of the conductive body and a second latching element integrally formed therewith and extending outwardly therefrom on the second side of the conductive body;

an electrical contact having a multiplicity of curved, resilient contact members mounted in the arcuate section of the conductive body; and an electrically insulating housing substantially surrounding the conductive body, the housing having a first opening in a bottom thereof into a cavity having a first recess along a first side thereof for receiving the first latching element and a second recess along a second side thereof for receiving the second latching element, the housing having a second opening in another surface thereof for receiving a mating conductive pin.

7. The electrical connector of claim 6, further comprising:

a contact pin mounted in the arcuate section of the conductive body, the contact pin retained within and extending through the second opening in the housing.

8. The electrical connector of claim 6 wherein the distance between a center of the at least one contact terminal extending from the first side of the conductive body and a center of the at least one contact terminal extending from the second side of the conductive body is about 0.2 inches or less.

9. The electrical connector of claim 6 wherein the distance between a center of the at least one contact terminal extending from the first side of the conductive body and a center of the at least one contact terminal extending from the second side of the conductive body is about 0.1 inches or less.

10. The electrical connector of claim 6, further comprising:

an electrically insulating member mounted in the first opening of the housing.

11. The electrical connector of claim 10 wherein the at least one contact terminal on each side of the conductive body extend through an opening through the insulating member.

* * * * *